US009041496B2

(12) United States Patent
Puoskari et al.

(10) Patent No.: US 9,041,496 B2
(45) Date of Patent: May 26, 2015

(54) ADJUSTABLE RESONATOR

(75) Inventors: Jukka Puoskari, Tupos (FI); Petri Päri, Kempele (FI)

(73) Assignee: Intel Corporation, Santa Clara, CA (US)

( * ) Notice: Subject to any disclaimer, the term of this patent is extended or adjusted under 35 U.S.C. 154(b) by 253 days.

(21) Appl. No.: 13/478,018

(22) Filed: May 22, 2012

(65) Prior Publication Data

US 2012/0313735 A1 Dec. 13, 2012

(30) Foreign Application Priority Data

Jun. 8, 2011 (FI) ..... 20115557

(51) Int. Cl.
*H01P 7/04* (2006.01)

(52) U.S. Cl.
CPC ..... *H01P 7/04* (2013.01)

(58) Field of Classification Search
CPC ..... H01P 1/202; H01P 7/07; H01P 1/2056
USPC ..... 333/207, 224–226
See application file for complete search history.

(56) References Cited

U.S. PATENT DOCUMENTS

| | | | | |
|---|---|---|---|---|
| 2,500,875 A | | 3/1950 | Schupbach | |
| 2,530,089 A | * | 11/1950 | Smith | 333/225 |
| 2,774,044 A | | 12/1956 | Silvey et al. | |
| 3,336,542 A | | 8/1967 | Hancock | |
| 3,596,204 A | * | 7/1971 | Vane | 331/91 |
| 4,794,354 A | * | 12/1988 | Dinsmore et al. | 333/207 |
| 6,255,922 B1 | | 7/2001 | Malmstrom et al. | |
| 7,474,176 B2 | | 1/2009 | Henningsson et al. | |
| 7,728,700 B2 | * | 6/2010 | Sieber et al. | 333/206 |

FOREIGN PATENT DOCUMENTS

| | | |
|---|---|---|
| GB | 2305547 | 4/1997 |
| GB | 2448875 | 11/2008 |

OTHER PUBLICATIONS

European Search Report dated Oct. 22, 2012 from European Application No. 12169907.8, 4 pages.
Finland Search Report for Application No. 30226668 dated Dec. 5, 2011.

* cited by examiner

*Primary Examiner* — Benny Lee
*Assistant Examiner* — Gerald Stevens
(74) *Attorney, Agent, or Firm* — Schwegman Lundberg & Woessner, P.A.

(57) ABSTRACT

The adjustable resonator according to the invention has a casing, which is composed of walls, a lid and a bottom, a resonator cavity inside the casing and an internal conductor inside the resonator cavity, which internal conductor is in electric contact with the casing. The resonator further comprises a moveable adjustment piece, which comprises a conductive adjustment member, a conductive upper plate, and a dielectric support member. The adjustment member has a stem, which is vertical, and a cap as an expansion thereof. The adjustment member can be moved downwards so that its stem and the fixed internal conductor connected to the bottom of the resonator go within each other. The movement of the adjustment piece in the coaxial resonator first decreases the resonance frequency and then slowly increases it. Therefore the resonator provides a very wide adjustment area for the resonance frequency.

11 Claims, 7 Drawing Sheets

ADJUSTABLE RESONATOR

BACKGROUND OF THE INVENTION

The invention relates to a coaxial cavity resonator, the resonance frequency of which can be adjusted.

Cavity resonators are generally used in communications networks for making filters, especially when the power of the signal to be transferred is relatively large. This is due to the fact that losses caused by such resonator filters are small, which means only a slight attenuation of the effective signal. Additionally their response characteristics are easy to control and set even according to strict specifications.

In most filters, both the location and width of the pass band of the filter is meant to be fixed. In some filters the width of the pass band of the filter is meant to be constant, but the location of the pass band must be possible to select from within a certain total area. Thus an adjustment possibility for moving the pass band is needed in the filter in addition to the basic tuning.

The structure of a coaxial cavity resonator, or shorter a coaxial resonator, comprises an internal conductor, an external conductor consisting of the side walls, a bottom and a lid. The bottom and the lid are in galvanic contact with the external conductor, and all three together form a closed resonator casing. Usually the lower end of the internal conductor is galvanically connected to the bottom and the upper end is in the air, whereby the transmission wire formed by the resonator is short-circuited in its lower end and open in its upper end.

The adjustment of the resonance frequency of the resonator is usually based on the fact that the capacitance between the internal conductor and the lid is changed, whereby also the electric length and resonance frequency of the resonator change. Metallic tunings screws placed in the lid of the resonator are generally used as adjustment parts. When turning the screw its distance from the internal conductor of the resonator changes, as a result of which the capacitance between the internal conductor and the lid changes. A disadvantage with using tuning screws is that the screw accessories increase the number of parts of the filter and the threaded screw holes mean an increase in work stages and thus an increase in manufacturing costs. Additionally the electric contact in the threads can deteriorate over time, which causes changes in the tuning and an increase in losses in the resonator. In high capacity filters there is also a danger of breakthrough, if the tip of the screw is close to the end of the internal conductor. The tuning thus takes time and is relatively expensive.

U.S. Pat. No. 6,255,922 presents a resonator, which has a moveable piece for adjusting the resonance frequency, which piece is made from a non-conductive material, which piece is moved inside a resonator piece made from a ceramic material. The structure is quite complicated, and it is not able to provide very large adjustments in the resonance frequency.

U.S. Pat. No. 7,474,176 introduces a cavity resonator, where the size of the internal conductor of the resonator is changed by moving an adjustment piece inside the internal conductor with a screw arrangement penetrating the resonator. This structure is also complicated and only able to make fine adjustments in the resonance frequency.

SUMMARY OF THE INVENTION

An object of the invention is a solution by which the drawbacks relating to the prior art can be considerably reduced. The objects are attained with a resonator which is characterised by what is presented in the independent claim. Some advantageous embodiments of the invention are presented in the dependent claims.

One main aspect of the invention is that a movement of an adjustment piece in the coaxial resonator first decreases the resonance frequency and then slowly increases it. This is achieved in the following manner: The moveable adjustment member of the resonator comprises a vertical conductive stem and a conductive cap as an expansion thereof. The adjustment member can be moved downwards so that its stem and the fixed internal conductor connected to the bottom of the resonator go within each other. The adjustment mechanism further comprises a conductive upper plate isolated from the adjustment member, which upper plate is in the resonator casing at a defined distance from the adjustment member, above it. The adjustment member and the upper plate are attached to a dielectric support member, which extends through the lid of the resonator to above the casing. The adjustment member, the upper plate and the support member thus form an adjustment piece, which is moved with the aid of the support members. The upper plate extends in the horizontal plane almost to the walls of the resonator cavity, whereby its lower surface defines the effective height of the cavity.

The stem of the adjustment member and the internal conductor of the resonator can be within each other, so that the internal conductor has a hollow wherein the stem partly goes or so that the stem has a hollow, wherein the internal conductor partly goes. In one embodiment both the stem and the internal conductor have a hollow. The hollow in the thinner part is cylindrical and the hollow in the thicker part forms a groove with a ring-like cross-section, wherein the thinner part fits. A galvanic isolation remains between the stem and the internal conductor, which can be ensured by coating at least a part of the surfaces of the stem or the internal conductor with a dielectric substance.

It is an advantage of the invention that a structure in accordance thereto provides a very wide adjustment area for the resonance frequency. Additionally the resonance frequency can within different sectors of this wide area be adjusted precisely. It is further an advantage of the invention that the Q value of a resonator in accordance thereto is high over the entre frequency adjustment area. It is further an advantage of the invention that the set resonance frequency is stable and does thus not change significantly over time. It is also an advantage of the invention that the structure in accordance thereto is simple, whereby the manufacturing costs remain relatively low.

BRIEF DESCRIPTION OF THE DRAWINGS

In the following, the invention will be described in detail. In the description, reference is made to the appended drawings, in which.

DETAILED DESCRIPTION OF THE INVENTION

Figure 1:
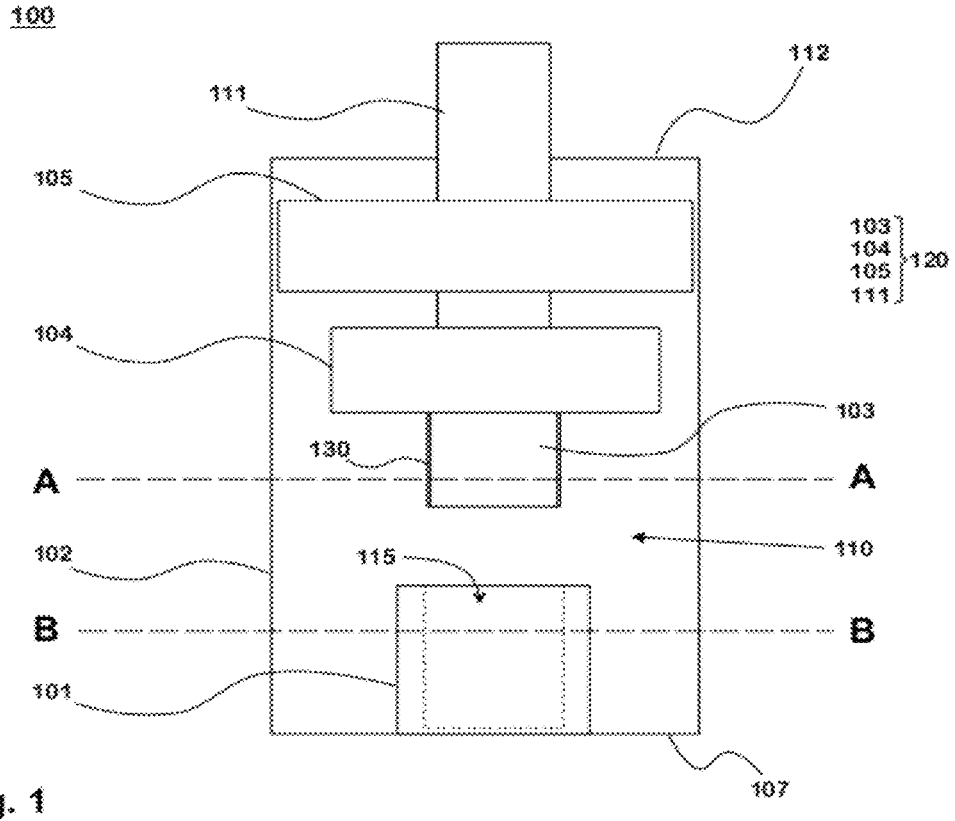
FIG. 1 shows an example of a cross-section of a resonator according to the invention.

FIG. 1 shows as a cross-section an example of an adjustable resonator according to the invention. The resonator 100 is a coaxial type resonator, whereby it comprises a casing made up of a wall 102, a bottom 107 and a lid 112, and a fixed internal conductor 101. The casing is at least partly made of a conductive material and within it is a resonator cavity 110. The internal conductor 101 is galvanically connected to the bottom 107. In the example in FIG. 1 the wall 102 forms a cylindrical pipe.

The resonator 100 further comprises a moveable adjustment piece 120, which comprises a conductive adjustment member 103, 104, a conductive upper plate 105 and a dielectric support member 111. The adjustment member has a stem 103, which is vertical, i.e. in the direction of the axis of the wall pipe, and a cap 104 as an expansion thereof. The upper plate is in the resonator casing at a defined distance from the cap of the adjustment member, above it. The adjustment member and the upper plate are attached to the dielectric support member 111, which extends through the lid of the resonator to above the casing. The adjustment piece 120 is moved in the vertical direction with the aid of the support member 111 from outside the casing. The stem, the cap and the upper plate are in this example cylindrical. The upper plate 105 extends in the horizontal plane in every direction almost to the walls of the resonator, whereby its lower surface defines the effective height of the resonator cavity. The diameter of the cap is in this example smaller than the diameter of the upper plate. More commonly the cross-sectional surface area of the cap can be smaller than the cross-sectional surface are of the upper plate.

The internal conductor 101 has an upwards-opening cylindrically shaped hollow 115, the diameter of which is slightly larger than the diameter of the stem 103 and the axis of which is the same as the axis of the stem. Therefore the stem can go at least partly into the hollow in the internal conductor, when the adjustment piece is moved downwards. The outer surface of the stem or the inner surface of said hollow or both may have a dielectric coating 130 to ensure that the stem and the internal conductor do not come into galvanic contact with each other.

Figure 2:
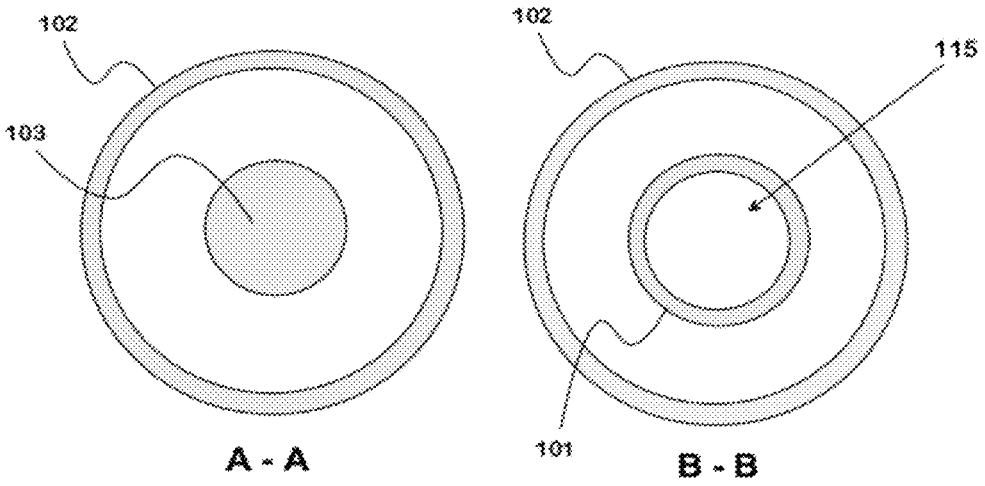
FIG. 2 shows a cross-section of the resonator according to FIG. 1 in two points, FIGS. 3(*a*)-3(*e*) show the adjustment of the resonator according to FIG. 1.

FIG. 2 shows a cross-section of the resonator according to FIG. 1 at point A, i.e. by the stem of the adjustment member. The wall 102 of the resonator can be seen therein as a circular ring and the stem 103 as a circle. The figure further shows a cross-section of the resonator at point B, i.e. by the internal conductor. The wall 102 of the resonator can be seen therein, and the internal conductor 101 as a circular ring. In the centre of this ring is the hollow 204 of the internal conductor.

Figure 3:
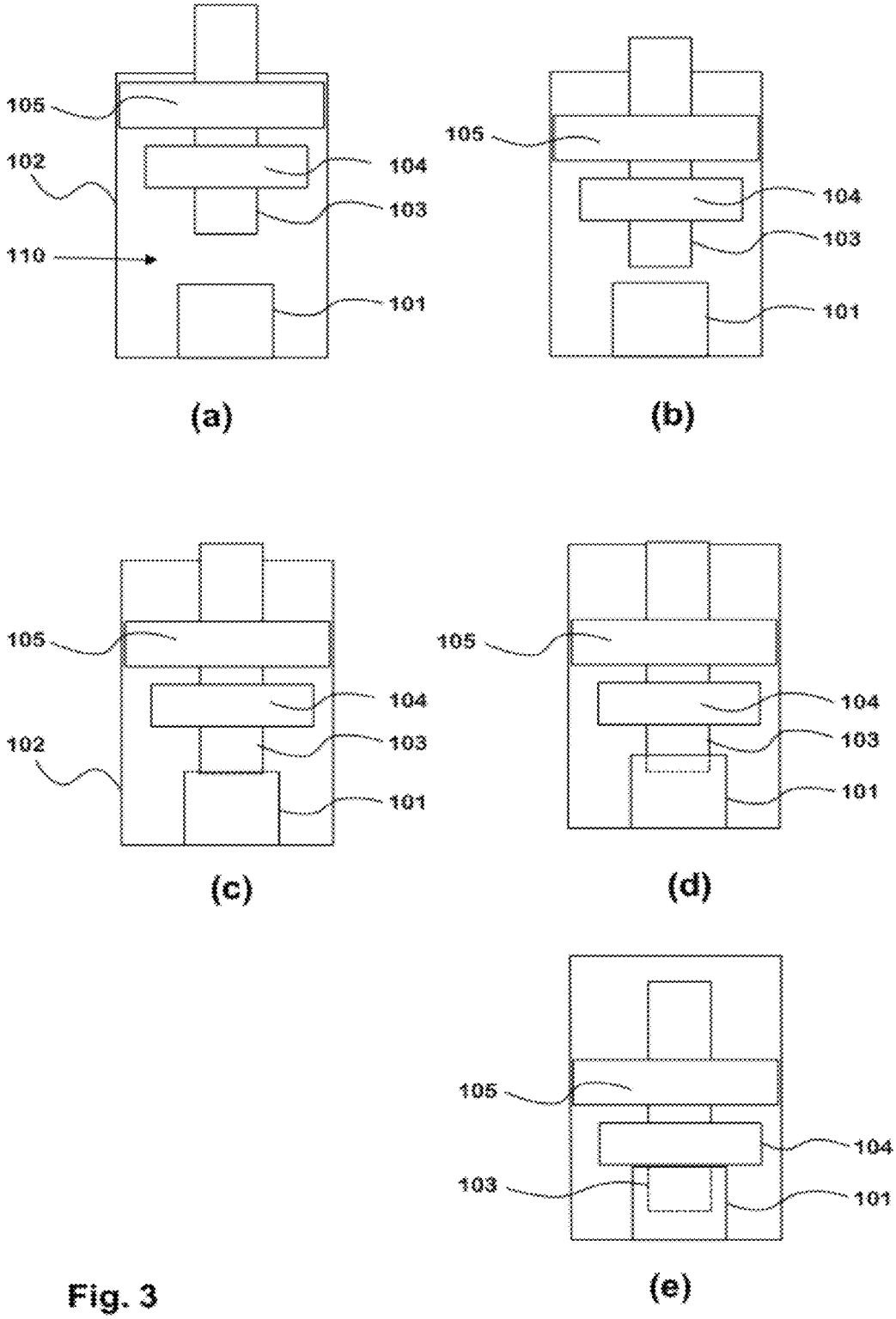

FIG. 3 shows an example of the adjustment of the resonator according to FIG. 1. In the example the dimensions of the resonator are as follows. The height of the resonator is 58 mm and the diameter of the resonance cavity 110 is 40 mm. The height of the internal conductor 101 is 19 mm and its diameter is 13 mm. The diameter of the hollow of the internal conductor is 11 mm. The diameter of the stem 103 of the adjustment member is 10 mm and its length measured from the cap 104 of the adjustment member is 20 mm. The height of the cap is 8 mm and its diameter is 34 mm. The distance between the cap and the upper plate 105 is 2 mm. The height of the upper plate is 6 mm and its diameter is 39 mm.

FIGS. 3(*a*)-3(*e*) show the adjustment piece 120 in five different positions. In FIG. 3(*a*) the adjustment piece is in its upper position, whereby also the lower surface of the stem of the adjustment member is clearly above the internal conductor. In FIG. 3(*b*) the adjustment piece has been moved downwards by 4.5 mm, whereby the stem is still completely above the internal conductor. In FIG. 3(*c*) the adjustment piece has been moved downwards by 9 mm, whereby the lower surface of the stem is slightly below the level of the upper surface of the internal conductor. In FIG. 3(*d*) the adjustment piece has been moved downwards by 14.5 mm, whereby the lower end of the stem is already clearly in the hollow of the internal conductor. In FIG. 3(*e*) the adjustment piece has been moved downwards by 25 mm, whereby the stem is almost completely in the hollow of the internal conductor.

Figure 4:
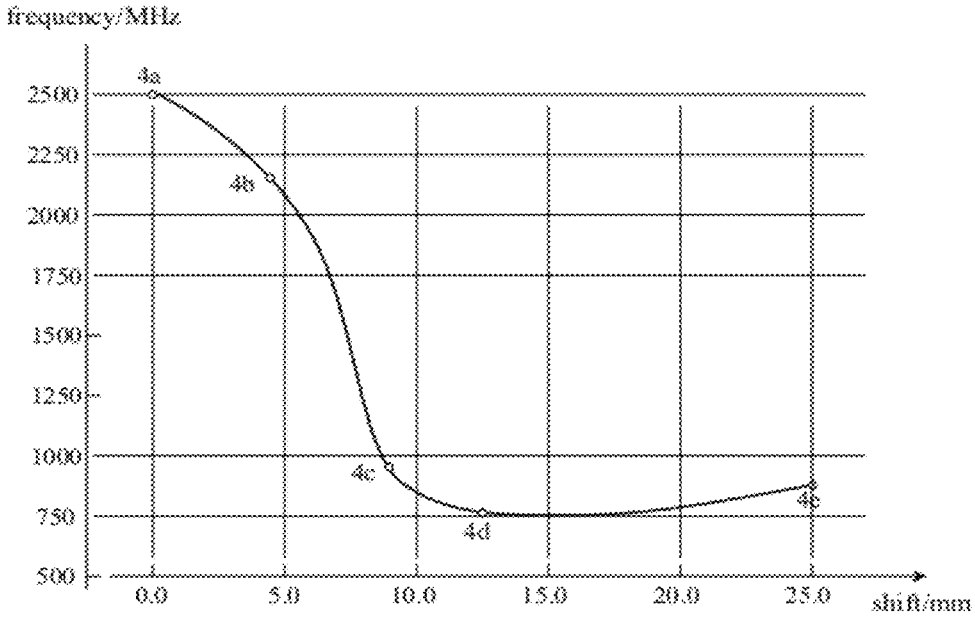
FIG. 4 shows the resonance frequency of a resonator according to the invention as a function of the movement of the adjustment piece of the resonator.

FIG. 4 shows the resonance frequency of the resonator according to the invention as a function of the displacement of the adjustment piece. The resonator is in accordance with FIGS. 1 and 3 with the distinction that the hollow of the internal conductor has a conductor pin in the middle and the stem of the adjustment member is correspondingly hollow. Point 4*a* in the diagram corresponds to the situation in FIG. 3(*a*), point 4*b* the situation in FIG. 3(*b*), point 4*c* the situation in FIG. 3(*c*), point 4*d* the situation in FIG. 3(*d*) and point 4*e* corresponds to the situation in FIG. 3(*e*).

From the diagram can be seen that the total adjustment area of the resonance frequency is very wide, about 750-2500 MHz. The resonance frequency is at its largest in point 4*a*, i.e. when the adjustment piece is in the upper position. When moving from there to point 4*b* the resonance frequency decreases relatively slowly to a value of about 2150 MHz. This means that in the upper adjustment area 2150-2500 MHz in question, the resonance frequency can be set precisely. When moving from point 4*b* to point 4*c* the resonance frequency decreases relatively quickly to a value of about 940 MHz. This is because the stem 103 of the adjustment member thus gets closer to the internal conductor 101, reaching the level, when the capacitance between the internal conductor and the walls of the casing increases quickly, which results in an increase in the electric length of the resonator. When moving from point 4*c* to point 4*d* the resonance frequency still decreases, but it slows down and reaches its minimum value of about 750 MHz in point 4*d*. After point 4*d* the resonance frequency starts to increase again, increasing slowly to a value of about 875 MHz when moving from point 4*d* to point 4*e*. The turn in the resonance frequency is due to the fact that when the stem of the adjustment member enters the fixed internal conductor the adjustment member is functionally altered into a part of the internal conductor, and the length of this extended 'internal conductor' is decreased as the adjustment piece moves further downward. Additionally the upper plate 105 makes the resonance cavity smaller as it is lowered down, which also causes an increase in the resonance frequency.

The slow change in the resonance frequency in the lower adjustment area 750-875 MHz in question means that the resonance frequency can be set precisely at the desired value.

Figure 5:
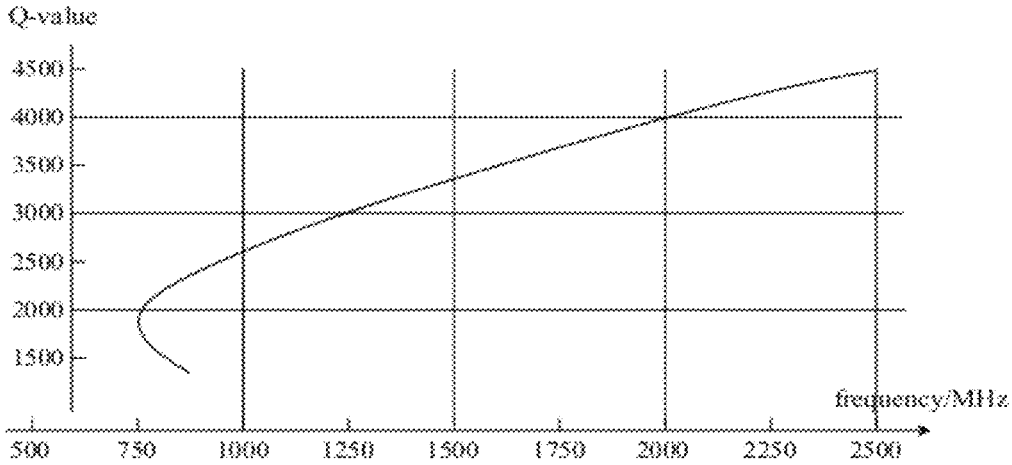
FIG. 5 shows the Q value of a resonator corresponding to the one in FIG. 4 as a function of the resonance frequency.

FIG. 5 shows the Q value of the resonator corresponding to the one in FIG. 4 as a function of the resonance value. The larger the Q value is, the smaller the losses of the resonator are. The Q value is at its largest in said upper adjustment area, over 4000, and at its smallest in the lower adjustment area, on average about 1500. This is still a good value.

Figure 6:
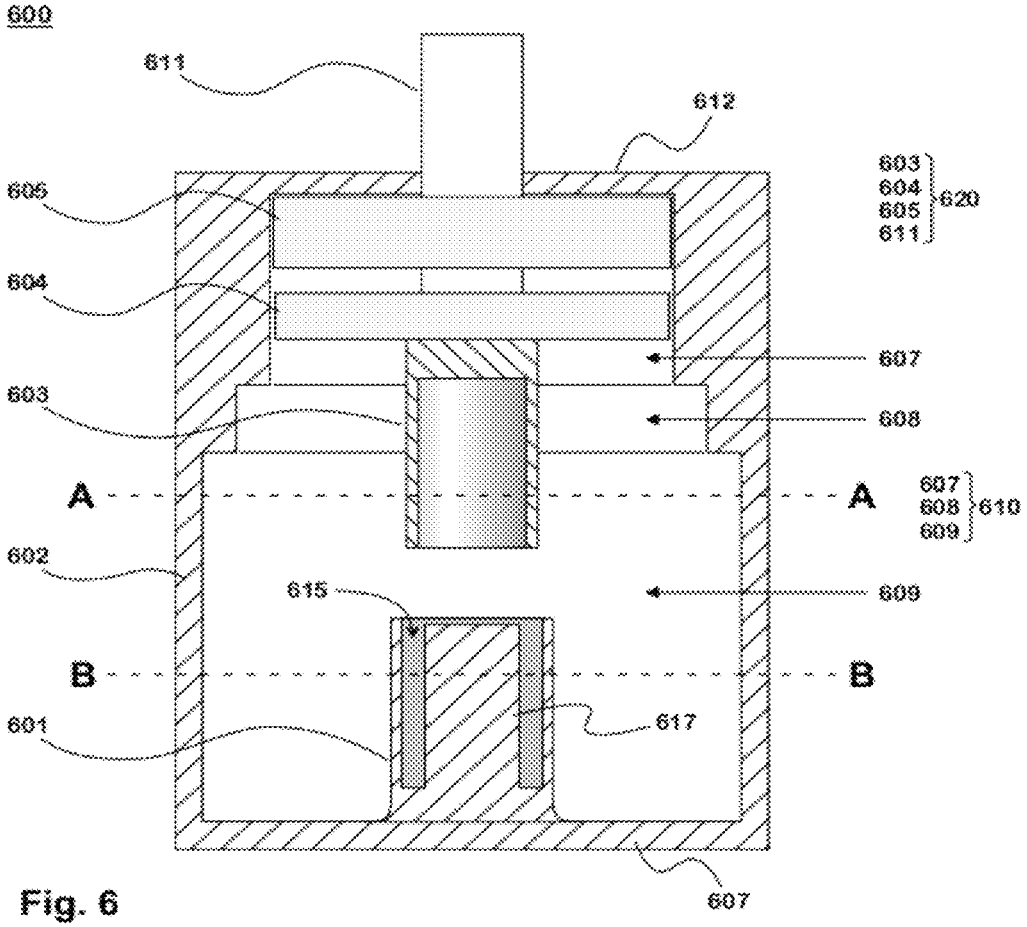
FIG. 6 shows a second example of a cross-section of a resonator according to the invention.

FIG. 6 shows as a cross-section a second example of a resonator according to the invention. The resonator 600 is a coaxial type resonator, whereby it comprises a casing made up of a wall 602, a bottom 607 and a lid 612, and a fixed internal conductor 601, as in FIG. 1. The outer shape of the resonator is also in this example cylindrical. The resonator 600 also comprises a moveable adjustment piece 620, which comprises a conductive adjustment member 603, 604, a conductive upper plate 605 and a dielectric support member 611. The adjustment member has a vertical stem 603 and a cap 604. Further as in FIG. 1, the upper plate is in the resonator casing at a defined distance from the cap of the adjustment member, above it. The adjustment member and the upper plate are attached to each other with said support member 611, which extends through the lid of the resonator to above the casing. The upper plate and the stem and cap of the adjustment member are cylindrical.

The difference to the structure shown in FIG. 1 is that the cross-sectional surface area of the resonator cavity 610 is now not constant, but it is larger in the lower part of the resonator than in the upper part. In this example the cavity has three parts, which have different diameters. The diameter of the upper part 607 of the cavity is only slightly larger than the diameter of the upper plate 605 and cap 604. The diameter of the middle part 608 of the cavity, which is relatively low, is somewhat larger than the diameter of the upper part. The diameter of the lower part 609 of the cavity, which is relatively high, is still somewhat larger than the diameter of the middle part.

A second difference to the structure shown in FIG. 1 is that the stem 603 of the adjustment member now also has a cylindrical downward-opening hollow, and the hollow 615 of the internal conductor 601 forms a groove with a ring-like cross-section, wherein the lower end of the stem fits. A vertical conductor pole 617 surrounded by said groove is thus left in the centre of the internal conductor. The purpose of such an arrangement is to increase the capacitance between the stem of the adjustment member and the internal conductor when they are within each other.

Figure 7:
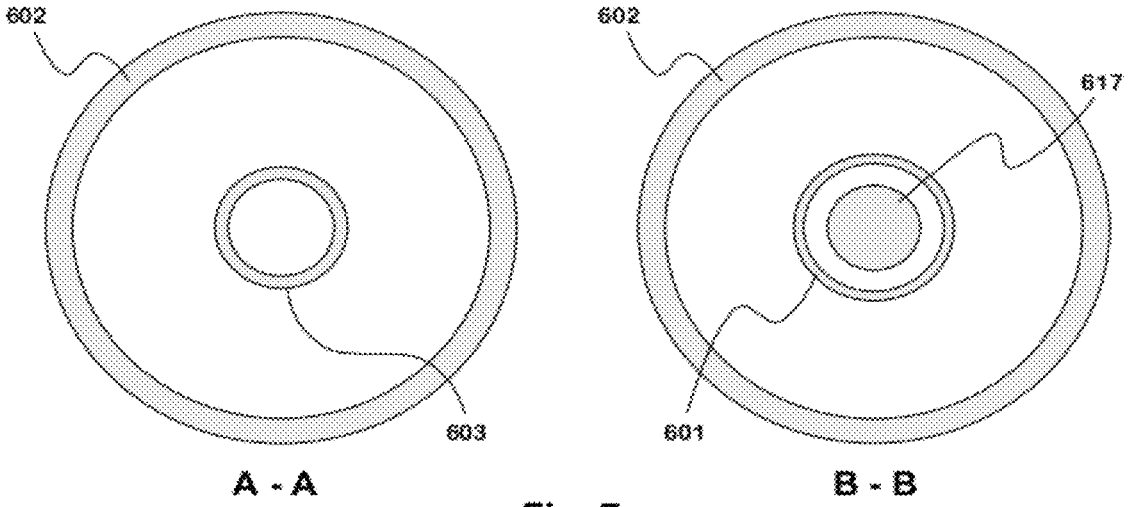
FIG. 7 shows a cross-section of the resonator according to FIG. 6 in two points, FIGS. 8(*a*)-8(*d*) show the adjustment of the resonator according to FIG. 6.

FIG. 7 shows a cross-section of the resonator according to FIG. 6 at point A, i.e. by the stem of the adjustment member. The wall 602 of the resonator can be seen therein as a circular ring and the stem 603 also as a circular ring. An empty space is left in the centre due to the hollow of the stem. The figure further shows a cross-section of the resonator at point B, i.e. by the internal conductor. The wall 602 of the resonator can be seen therein, along with the outermost part of the internal conductor 601 as a circular ring and in the middle said conductor pole 617 belonging to the internal conductor as a ring.

In order to ensure the galvanic separation of the stem 603 and the internal conductor 601, there may be a dielectric coating for example on the outer surface of the stem and on the surface of its hollow or on the inner surface of the outer part of the internal conductor and on the surface of the conductor pole 617.

Figure 8:
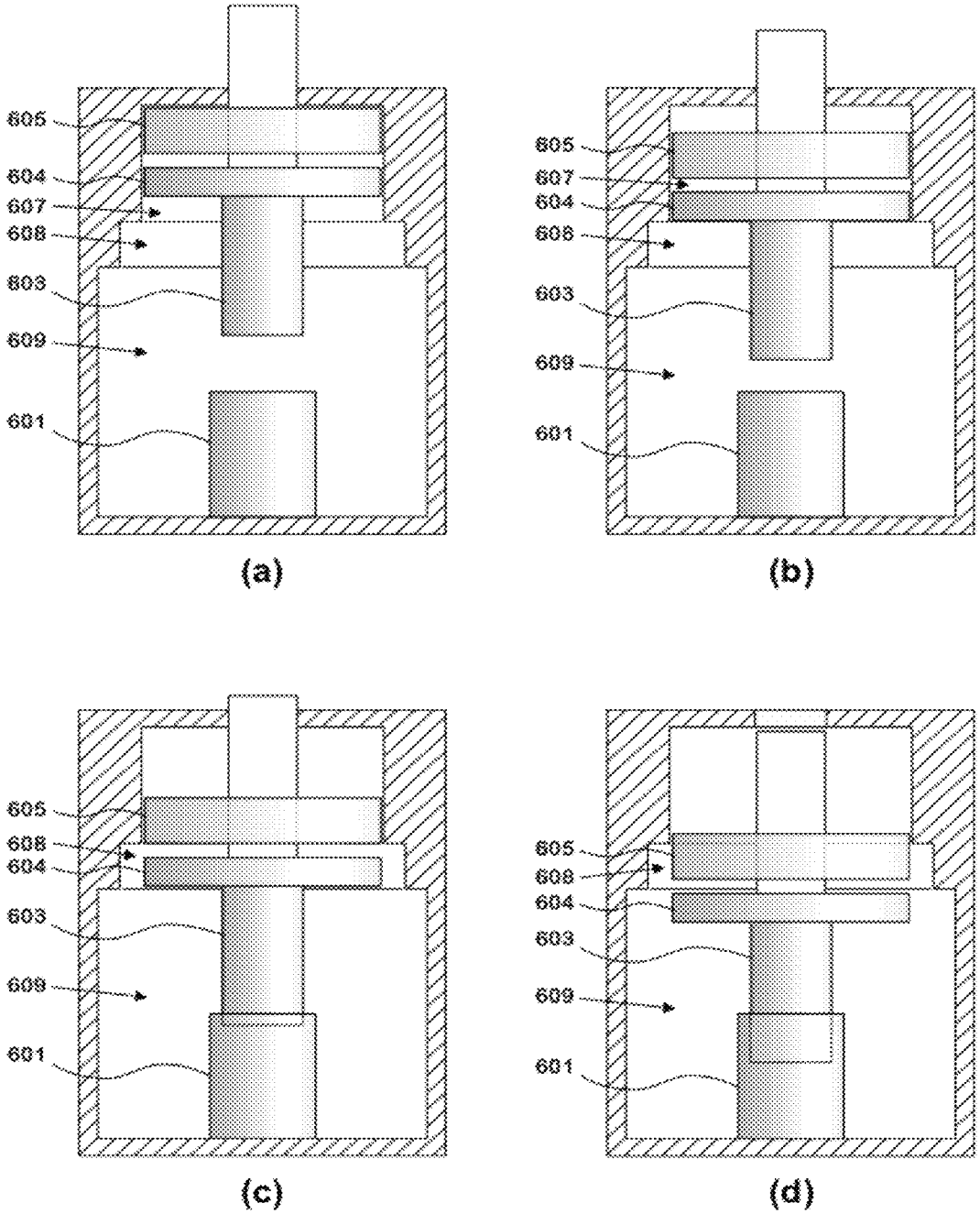

FIG. 8 shows an example of the adjustment of the resonator according to FIG. 6. In the example the dimensions of the resonator are as follows. The height of the entre resonator cavity is 56 mm. The height of the upper part 607 of the cavity is 16 mm and its diameter is 30.4 mm. The height of the middle part 608 of the cavity is 6 mm and its diameter is 35 mm. The height of the lower part 609 of the cavity is 34 mm and its diameter is 40 mm. The height of the internal conductor 601 is 19 mm and its diameter is 13 mm. The outer diameter of the hollow of the internal conductor is 11 mm, and its inner diameter, i.e. the diameter of the conductor pole 617, is 7 mm. The length of the stem 603 of the adjustment member measured from the lower surface of the cap 604 of the adjustment member is 26.5 mm. The diameter of the stem is 10 mm and the diameter of its hollow is 8 mm. The height of the cap is 4 mm and its diameter is 30 mm. The distance between the cap and the upper plate 605 is 2 mm. The height of the upper plate is 6 mm and its diameter is 30 mm.

FIGS. 8(*a*)-8(*d*) show the adjustment piece 620 in four different positions. In FIG. 8(*a*) the adjustment piece is in its upper position, whereby the upper plate 605 and cap 604 are in the upper part 607 of the cavity and the lower surface of the stem 603 of the adjustment member is also clearly above the internal conductor 601. In FIG. 8(*b*) the adjustment piece has been moved downwards by 3.7 mm, whereby the upper plate and the cap are still in the upper part of the cavity while the lower surface of the cap is at the boundary between the upper and the middle part 608 of the cavity. The stem is still completely above the internal conductor. In FIG. 8(*c*) the adjustment piece has been moved downwards by 8.5 mm, whereby the upper plate is still in the upper part of the cavity, but the cap is in the middle part of the cavity. The lower end of the stem is somewhat below the level of the upper surface of the internal conductor, i.e. in the hollow of the internal conductor. In FIG. 8(*d*) the adjustment piece has been moved downwards by 15.5 mm, whereby the upper plate is mostly in the middle part of the cavity and the cap in the lower part 609 of the cavity. The stem is by its lower end about 9 mm inside the hollow of the internal conductor.

Figure 9:
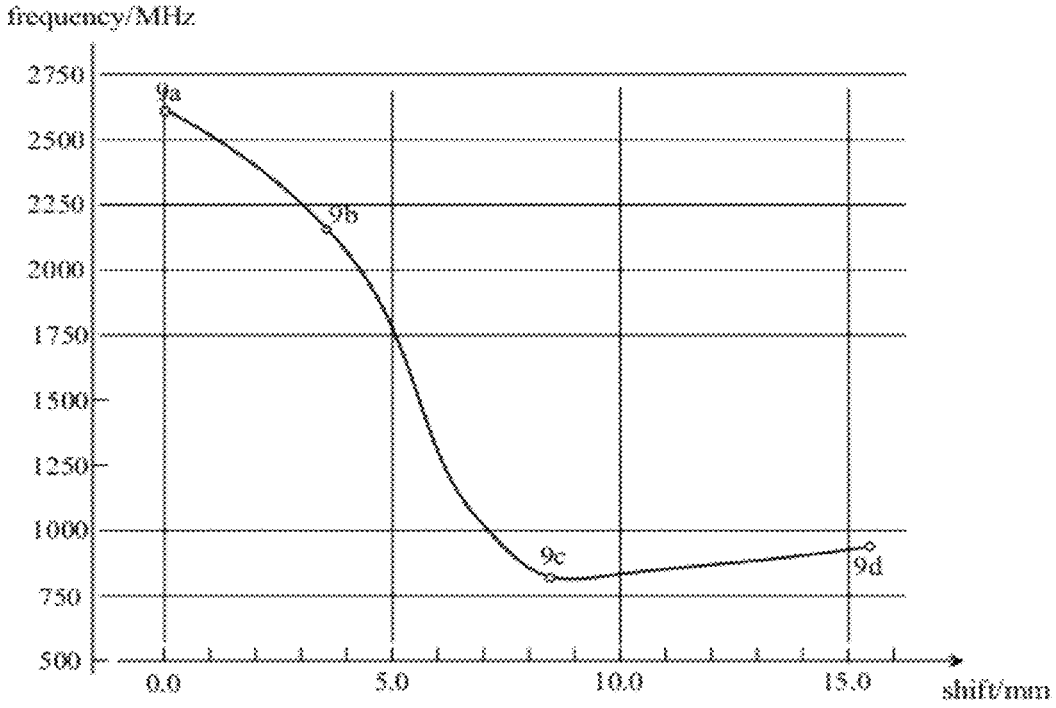
FIG. 9 shows the resonance frequency of a resonator according to FIG. 6 as a function of the movement of the adjustment piece of the resonator.

FIG. 9 shows the resonance frequency of the resonator according to the invention as a function of the displacement of the adjustment piece. The resonator is in accordance with FIGS. 6 and 7. Point 9*a* in the diagram corresponds to the situation in FIG. 8(*a*), point 9*b* the situation in FIG. 8(*b*), point 9*c* the situation in FIG. 8(*c*) and point 9*d* the situation in FIG. 8(*d*).

From the diagram can be seen that the total adjustment area of the resonance frequency is about 810-2610 MHz. The resonance frequency is at its largest in point 9*a*, i.e. when the adjustment piece is in the upper position. When moving from there to point 9*b* the resonance frequency decreases to a value of about 2130 MHz. When moving from point 9*b* to point 9*c* the resonance frequency decreases further to a value of about 810 MHz. The decrease is also in this example due to the fact that the stem 603 of the adjustment member gets closer to the internal conductor 601, whereby the capacitance of the internal conductor to the walls of the casing increases via the cap 604, which results in an increase in the electric length of the resonator. The diameter of the cap is here almost the same as the diameter of the upper part of the cavity, wherefore the cap has a relatively strong capacitive coupling to the resonator casing. The adjustment member is thus in practice grounded, when the casing is called a signal ground. The decrease in the resonance frequency is the quickest when the lower end of the stem comes relatively close to the upper end of the internal conductor. When the lower surface of the stem reaches the level of the upper surface of the internal conductor, the cap of the adjustment member has already moved into the wider middle part of the cavity, whereby its coupling to the casing weakens. This results in that the decrease in the resonance frequency ceases, and the minimum frequency of 810 MHz is reached in said point 9*c*.

After point 9*c* the resonance frequency again starts to increase, slowly rising to a value of about 950 MHz when arriving at point 9*d*, i.e. the bottom position of the adjustment piece. The turn in the resonance frequency is also in this example due to the fact that when the stem of the adjustment member enters the fixed internal conductor the adjustment member is functionally altered into a part of the internal conductor, and the length of this extended 'internal conductor' is decreased as the adjustment piece moves further downward. The above-described design of the internal conductor and stem means that the capacitive coupling between them is remarkably strong immediately as the lower end of the stem enters the hollow of the internal conductor. Additionally the upper plate 605 makes the resonance cavity smaller as it is lowered down, which also causes an increase in the resonance frequency. The upper plate has this effect during the entire movement of the adjustment piece, but in the end stage it has a greater importance.

FIG. 9 shows that the resonance frequency can especially between points 9*c* and 9*d* be adjusted very precisely due to its slow change. This lower adjustment area is 810-950 MHz. The adjustment can be made relatively precise also in the upper end of the adjustment area. The upper adjustment area situated in the upper end is for example 2000-2600 MHz. The usable adjustment areas can naturally be selected with the aid of suitable dimensioning of the resonator and material selections.

Figure 10:
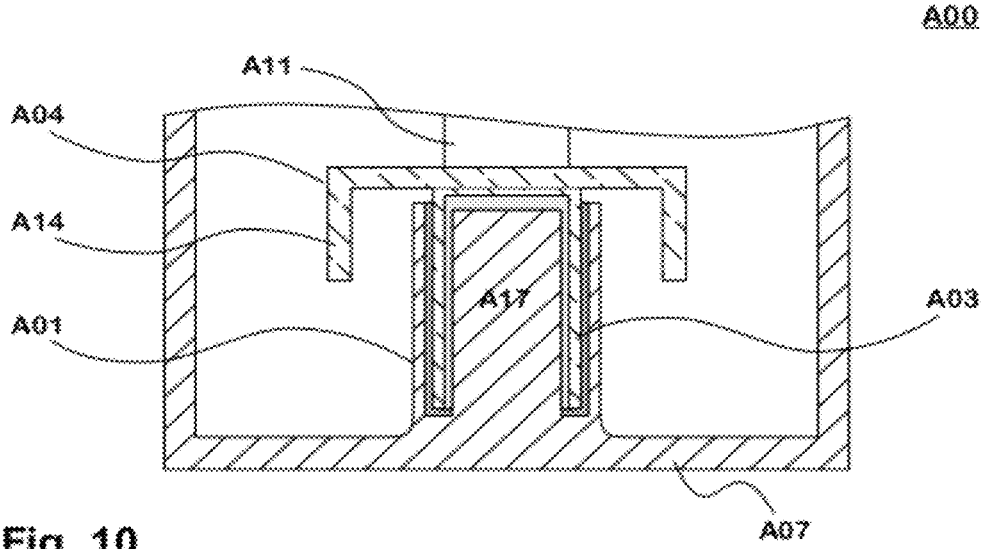
FIG. 10 shows a third example of a cross-section of a resonator according to the invention.

FIG. 10 shows as a cross-section a third example of a resonator according to the invention. The resonator A00 is a cylindrical coaxial resonator and it has the same structural parts as in the previous examples. A difference to the structure shown in FIG. 6 is a different structure of the cap of the adjustment member. The resonator has therefore been split open between the upper plate and the cap A04, so that only the lower part is shown in FIG. 10. The cap has a horizontal plate but this is significantly thinner than in FIG. 6, and a skirt A14 extends towards the bottom A07 from the edge of the plate. The cap is thus reminiscent of a downward-opening cup.

The above-described structure results in that if the dimensioning of the resonator is otherwise the same as in FIG. 6, the adjustment member and the entire adjustment piece can be moved lower down than in FIG. 6. In FIG. 10 the adjustment piece has with the aid of a support member A11 been moved to its bottom position. Thus the skirt A14 of the cap is around the internal conductor A01, which affects the adjustment properties of the resonator. The stem A03 of the adjustment member is in the hollow of the internal conductor around the conductor pole A17 of the internal conductor.

A resonator according to FIG. 1 can for example also be modified so that the cap of the adjustment member has a skirt structure.

Figure 11:
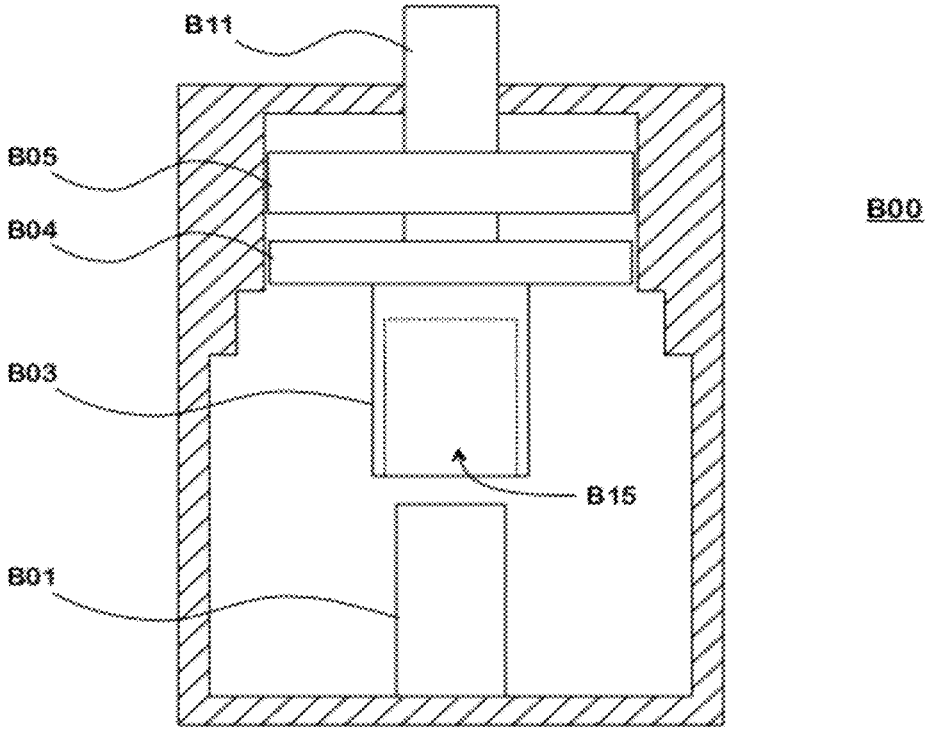
FIG. 11 shows a fourth example of a cross-section of a resonator according to the invention.

FIG. 11 shows as a cross-section a fourth example of a resonator according to the invention. The resonator BOO comprises a conductor casing, a fixed internal conductor B01 and an adjustment piece composed of an adjustment member B03, B04, an upper plate B05 and a dielectric support member B11, as in the previous examples. A significant different to the previous examples is that the diameter of the internal conductor B01 is now smaller than the diameter of the stem B03 of the adjustment member. The stem has a downward-opening hollow B15, the diameter of which is slightly larger than the diameter of the internal conductor. Thus, when the adjustment piece is moved downwards, the internal conductor ends up at least partly inside the stem of the adjustment member, being isolated therefrom.

The definitions "horizontal", "vertical", "lower", "upper", "downwards" and "upwards" in this description and claims refer to the position of the resonator, where the lid and the bottom of its casing are in a horizontal position, the lid being higher, and these definitions have nothing to do with the use position of the resonator.

Some embodiments of the invention have been described above. The invention is not limited to the embodiments just described, for example the resonator and its adjustment parts do not need to have a cylindrical shape. The inventive idea may be applied in different ways.

What is claimed is:

1. An adjustable resonator which has a casing composed of walls, a lid and a bottom establishing a resonator cavity therein, a fixed internal conductor galvanically connected to the bottom, whereby the resonator is a coaxial type cavity resonator, and a moveable resonance frequency adjustment piece, wherein said adjustment piece comprises an adjustment member situated in the resonator cavity, which adjustment member has a vertical conductive stem and in an upper end thereof a conductive cap, a conductive upper plate and a dielectric support member, whereto the adjustment member and the conductive upper plate are attached, which conductive upper plate is substantially parallel to and space at a distance from the conductive cap of the adjustment member, above it, and extends in a horizontal plane in every direction almost to the walls of said resonator cavity, which support member extends in a vertical direction through the resonator lid above it, and when the adjustment piece is in an uppermost position, the stem of the adjustment member is completely above the fixed internal conductor, and the stem and the fixed internal conductor are arranged to go at least partly within each other in order to increase a capacitance between the adjustment member and the fixed internal conductor when moving the adjustment piece downwards.

2. The resonator according to claim 1, wherein said fixed internal conductor has an upwards-opening hollow, where at least a lower end of the stem is isolated from the fixed internal conductor when the adjustment piece is in a lowest position.

3. The resonator according to claim 2, wherein said stem and said upwards-opening hollow in the fixed internal conductor are cylindrical and they have a common axis, whereby a diameter of the upwards-opening hollow of the fixed internal conductor is slightly larger than a diameter of the stem.

4. The resonator according to claim 2, wherein said stem and the fixed internal conductor have cylindrical outer surfaces and they have a common axis, said hollow in the internal conductor forms a groove with a ring-like cross-section, whereby a vertical conductor pole surrounded by this groove is left in the center of the internal conductor, and the stem has a cylindrical downward-opening hollow, so that the wall of the stem enters said groove of the internal conductor when moving the adjustment piece downward.

5. The resonator according to claim 1, wherein said stem has a downward-opening hollow, where at least the upper end of the internal conductor is isolated from the stem when the adjustment piece is in a lowest position.

6. The resonator according to claim 1, wherein a cross-sectional surface area of the conductive cap of the adjustment member is smaller than a cross-sectional surface area of the upper plate.

7. The resonator according to claim 1, wherein a cross-sectional surface area of the conductive cap of the adjustment member is substantially the same as a cross-sectional surface area of the upper plate.

8. The resonator according to claim 7, wherein a cross-sectional surface area of said resonator cavity is larger in the lower part of the cavity resonator than in an upper part, so that the capacitive coupling of said conductive cap to the resonator casing is substantially weaker when the adjustment piece is in a lower position than when the adjustment piece is in an upper position.

9. The resonator according to claim 1, wherein said stem of the adjustment member and/or the internal conductor has dielectric coating in order to ensure that the stem and the internal conductor do not come into galvanic contact with each other when they are within each other.

10. The resonator according to claim 1, wherein said resonator cavity and said conductive upper plate are cylindrical.

11. The resonator according to claim 1, wherein said conductive cap in addition to a horizontal plate has a skirt extending from its edge toward the bottom, which skirt is around the internal conductor when the adjustment piece is in a lower position.

* * * * *

UNITED STATES PATENT AND TRADEMARK OFFICE

CERTIFICATE OF CORRECTION

PATENT NO. : 9,041,496 B2
APPLICATION NO. : 13/478018
DATED : May 26, 2015
INVENTOR(S) : Puoskari et al.

It is certified that error appears in the above-identified patent and that said Letters Patent is hereby corrected as shown below:

On the title page
Item 56, in column 2, under "Foreign Patent Documents", line 2, after "GB 2448875 11/2008", insert --¶GB 2452293 A 3/2009
WO 2008087376 A1 7/2008--, therefor Item 56, in column 2, under "Other Publications", line 3, delete "30226668" and insert --20115557--, therefor Item 56, in column 2, under "Other Publications", line 4, after "2011", insert --¶Lech et al., "Analysis of Circular Cavity with Tunable Combline Resonator", 15th International Conference on Microwave Techniques (COMITE), Apr. 19, 2010, 4 pages.--, therefor Signed and Sealed this
Eighth Day of December, 2015

Michelle K. Lee

Michelle K. Lee
*Director of the United States Patent and Trademark Office*